US009289995B2

(12) United States Patent
Kakigahara

(10) Patent No.: US 9,289,995 B2
(45) **Date of Patent: *Mar. 22, 2016**

(54) LIQUID EJECTING APPARATUS

(71) Applicant: BROTHER KOGYO KABUSHIKI KAISHA, Nagoya-shi, Aichi-ken (JP)

(72) Inventor: Yutaka Kakigahara, Kariya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/557,839

(22) Filed: Dec. 2, 2014

(65) Prior Publication Data

US 2015/0183219 A1 Jul. 2, 2015

Related U.S. Application Data

(63) Continuation of application No. 13/613,289, filed on Sep. 13, 2012, now Pat. No. 8,905,505.

(30) Foreign Application Priority Data

Sep. 30, 2011 (JP) ..... 2011-218654

(51) Int. Cl.
*B41J 25/308* (2006.01)
*B41J 2/165* (2006.01)
*B41J 11/20* (2006.01)

(52) U.S. Cl.
CPC ..... *B41J 2/16511* (2013.01); *B41J 2/16535* (2013.01); *B41J 2/16585* (2013.01); *B41J 11/20* (2013.01)

(58) Field of Classification Search
CPC ..... B41J 2/16511; B41J 2/16535; B41J 2/16552; B41J 2/16588; B41J 2/2135
See application file for complete search history.

(56) References Cited

U.S. PATENT DOCUMENTS 4,893,137 A 1/1990 Ebinuma et al.
5,467,114 A 11/1995 Ebinuma et al.
5,552,812 A 9/1996 Ebinuma et al.
5,760,802 A 6/1998 Ebinuma et al.
7,717,529 B2 5/2010 Ito (Continued)

FOREIGN PATENT DOCUMENTS

JP 63-160850 A 7/1988
JP S63-160849 A 7/1988

(Continued)

OTHER PUBLICATIONS

Notification of Reason for Refusal issued in related Japanese Application No. 2011-218654, mailed Mar. 3, 2015.

*Primary Examiner* — Juanita D Jackson
(74) *Attorney, Agent, or Firm* — Merchant & Gould PC

(57) ABSTRACT

A liquid ejecting apparatus, including: a liquid ejecting head having an ejection surface; a platen; a capping mechanism including: a first member opposed to the ejection surface with the platen interposed therebetween when image recording is performed; and a second member disposed around the head so as to cooperate with the first member to hermetically close an ejection space; a distance adjusting mechanism for adjusting a distance between the ejection surface and the first member; a platen moving mechanism for moving the platen between the facing position and a non-facing position at which the platen does not face the ejection surface; and a controller configured to control the platen moving mechanism such that the platen is located at the non-facing position and controls the distance adjusting mechanism such that the distance is equal to a members-abuttable distance that allows the second and first members to abut on each other.

13 Claims, 10 Drawing Sheets

(56) References Cited

U.S. PATENT DOCUMENTS

| | | | | |
|---|---|---|---|---|
| 8,905,505 | B2 * | 12/2014 | Kakigahara | 347/8 |
| 2005/0093919 | A1 | 5/2005 | Takatsuka et al. | |

FOREIGN PATENT DOCUMENTS

| | | | |
|---|---|---|---|
| JP | H03-234623 | A | 10/1991 |
| JP | 2001-018402 | A | 1/2001 |
| JP | 2001-212990 | A | 8/2001 |
| JP | 2006-175883 | A | 7/2006 |
| JP | 2006-315200 | A | 11/2006 |
| JP | 2010-184421 | A | 8/2010 |
| JP | 2010-201788 | A | 9/2010 |
| JP | 2011-136531 | A | 7/2011 |

* cited by examiner

LIQUID EJECTING APPARATUS

CROSS REFERENCE TO RELATED APPLICATION

The present application is continuation application of U.S. patent application Ser. No. 13/613,289, filed Sep. 13, 2012, now U.S. Pat. No. 8,905,505, and further claims priority from Japanese Patent Application No. 2011-218654, which was filed on Sep. 30, 2011, the disclosure of both of which are herein incorporated by reference in their entirety.

BACKGROUND OF THE INVENTION

1. Field of the Invention

The present invention relates to a liquid ejecting apparatus configured to eject, to a recording medium, a liquid for recording an image.

2. Description of Related Art

In the liquid ejecting apparatus, there is known a technique of preventing a liquid in ejection openings from drying by hermetically closing or sealing, during a non-ejection period of the liquid, an ejection space that is opposed to an ejection surface of the liquid ejecting head in which the ejection openings are open, so as to isolate the ejection space from an external space. For instance, in one known ink-jet recording apparatus, a sleeve-like member disposed around head is brought into contact with a conveyor belt for conveying a recording medium, whereby the ejection surface is hermetically sealed from the external space by the ejection surface, the sleeve-like member, and the conveyor belt.

SUMMARY OF THE INVENTION

In the known ink-jet recording apparatus described above, the conveyor belt is used for hermetically sealing the ejection space from the external space. Where the ejection space is hermetically sealed from the external space using the conveyor belt as described above, it is not possible to sufficiently ensure hermeticity or air tightness of the ejection space since the conveyor belt is formed to have a configuration suitable for image recording on the recording medium, namely, a property in consideration of conveyance of the recording medium. Accordingly, there may be caused a problem that drying of the liquid in the ejection openings cannot be sufficiently prevented.

More specifically, the present invention provides a liquid ejecting apparatus, including:

a liquid ejecting head having an ejection surface in which ejection openings are open for ejecting a liquid, the liquid ejecting head being configured to record an image by ejecting the liquid toward a recording medium;

a platen configured to be located at a facing position at which the platen faces the ejection surface for supporting the recording medium, when image recording is carried out;

a capping mechanism configured to hermetically close an ejection space that is opposed to the ejection surface, with respect to an external space, the capping mechanism including: a first member configured to be disposed so as to be opposed to the ejection surface with the platen interposed therebetween, when the image recording is carried out; and a sleeve-like second member disposed around the liquid ejecting head so as to surround the liquid ejecting head, the second member being configured to cooperate with the first member to hermetically close the ejection space with respect to the external space;

a distance adjusting mechanism configured to adjust a distance between the ejection surface and the first member by moving at least one of the liquid ejecting head and the first member;

a platen moving mechanism configured to move the platen between the facing position and a non-facing position at which the platen does not face the ejection surface; and a controller configured to control the platen moving mechanism such that the platen is located at the non-facing position and to control the distance adjusting mechanism such that the distance between the ejection surface and the first member is equal to a members-abuttable distance that allows the second member and the first member to abut on each other.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
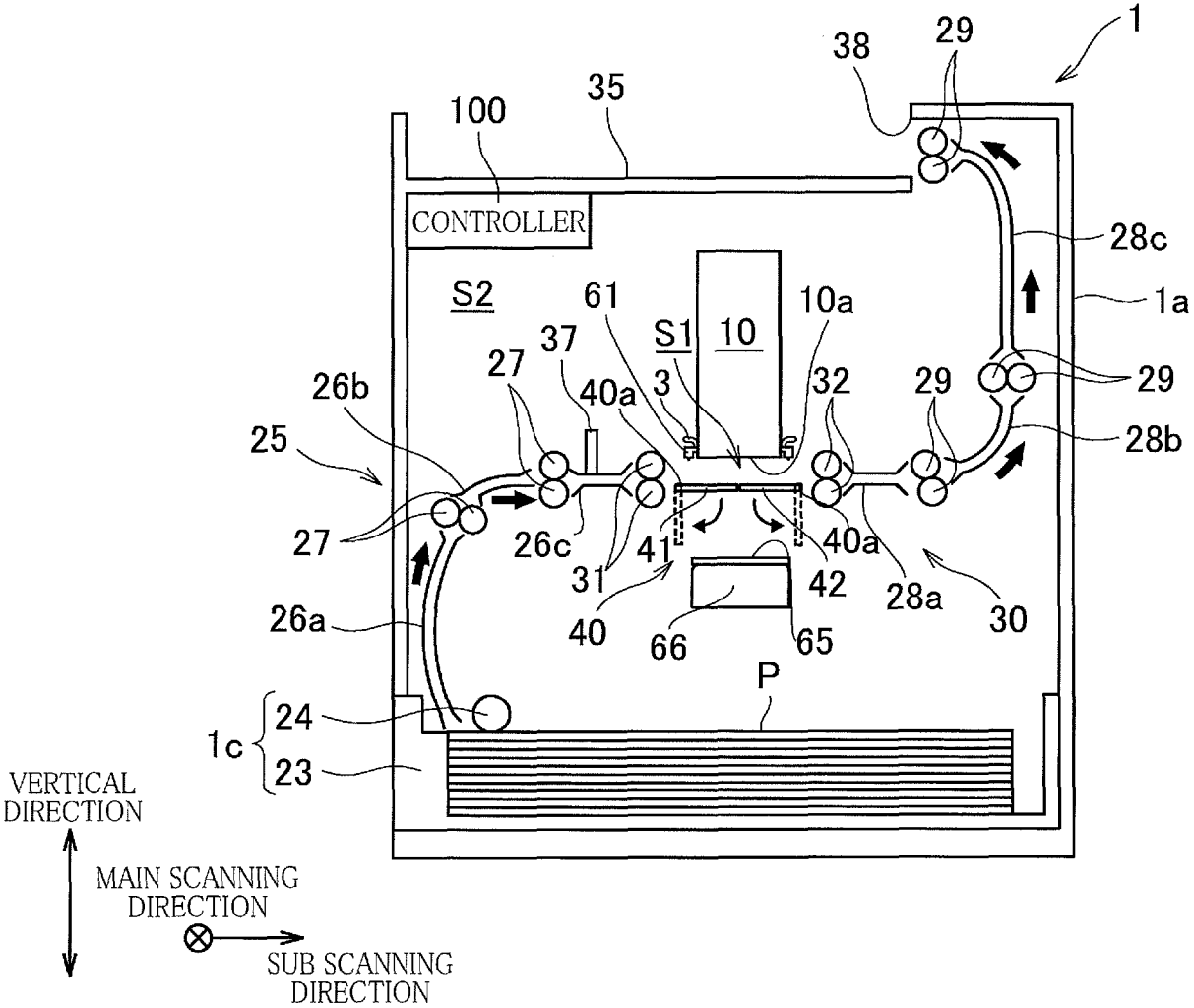
FIG. 1 is a schematic side view showing an overall structure of an ink-jet printer according to a first embodiment of the invention.

Hereinafter, there will be explained an embodiment of the present invention with reference to the drawings. Referring first to FIG. 1, there will be explained an overall structure of an ink-jet printer as one embodiment of a liquid ejecting apparatus according to the present invention.

The printer generally indicted at 1 in FIG. 1 has a casing 1*a* with a rectangular parallelepiped shape. A discharged-sheet receiving portion 35 is provided on a top plate of the casing 1*a*. In a space defined by the casing 1*a*, there is formed a sheet conveyance path through which a sheet P as a recording medium is conveyed from a sheet supply unit 1*c* toward the discharged-sheet receiving portion 35 along bold arrows in FIG. 1.

Figure 9:
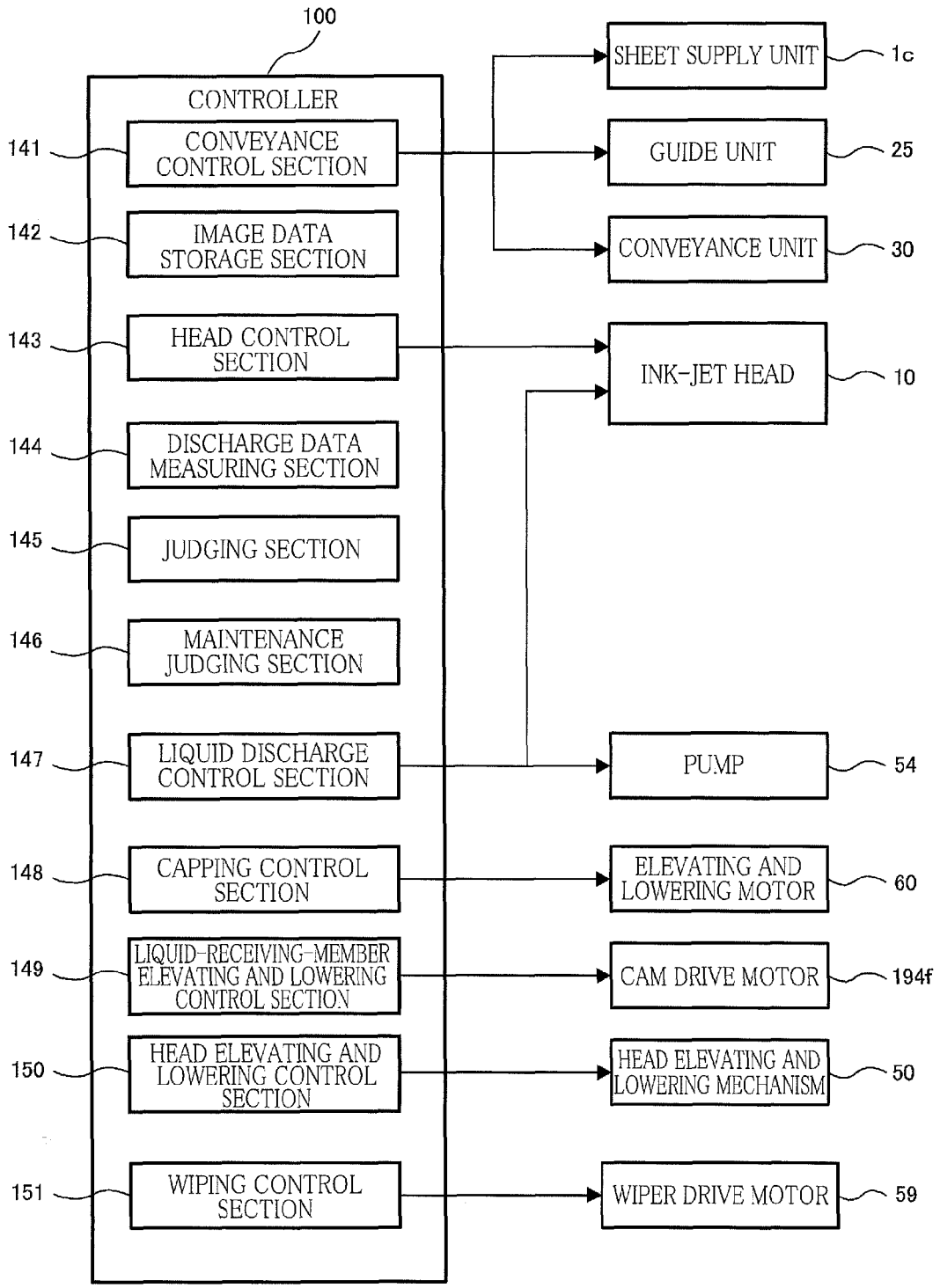
FIG. 9 is a block diagram showing an electric structure of a controller shown in FIG. 1.

The casing 1*a* accommodates: a head (liquid ejecting head) 10; a conveyance unit 30 for conveying the sheet P; a platen 40 for supporting the sheet P at a facing position (FIG. 2A) at which the platen 40 faces or is opposed to an ejection surface 10*a* of the head 10 when image recording is carried out; a guide unit 25 for guiding the sheet P; a cartridge (not shown) which stores black ink to be supplied to the head 10; a head elevating and lowering mechanism 50 (FIG. 9); a wiper unit 55 (FIG. 3); a liquid receiving member 65, as a first member, used in a capping operation for closing an ejection space S1 that is opposed to the ejection surface 10*a*; a movement mechanism 90 (FIG. 6); and a controller 100 for controlling operations of various portions of the printer 1. The cartridge is connected to the head 10 via a tube (not shown) and a pump 54 (FIG. 9).

The head 10 is a line head having a substantially rectangular parallelepiped shape that is long in a main scanning direction. A lower surface of the head 10 is the ejection surface 10*a* in which a multiplicity of ejection openings 108 (FIG. 5) are open. In image recording, the black ink is ejected from the ejection openings 108. The head 10 is supported by the casing 1*a* via a head holder 3. The head holder 3 holds the head 10 such that a prescribed spacing suitable for recording is formed between the ejection surface 10*a* and an upper surface of the platen 40. The concrete structure of the head 10 will be later explained.

Figure 8:
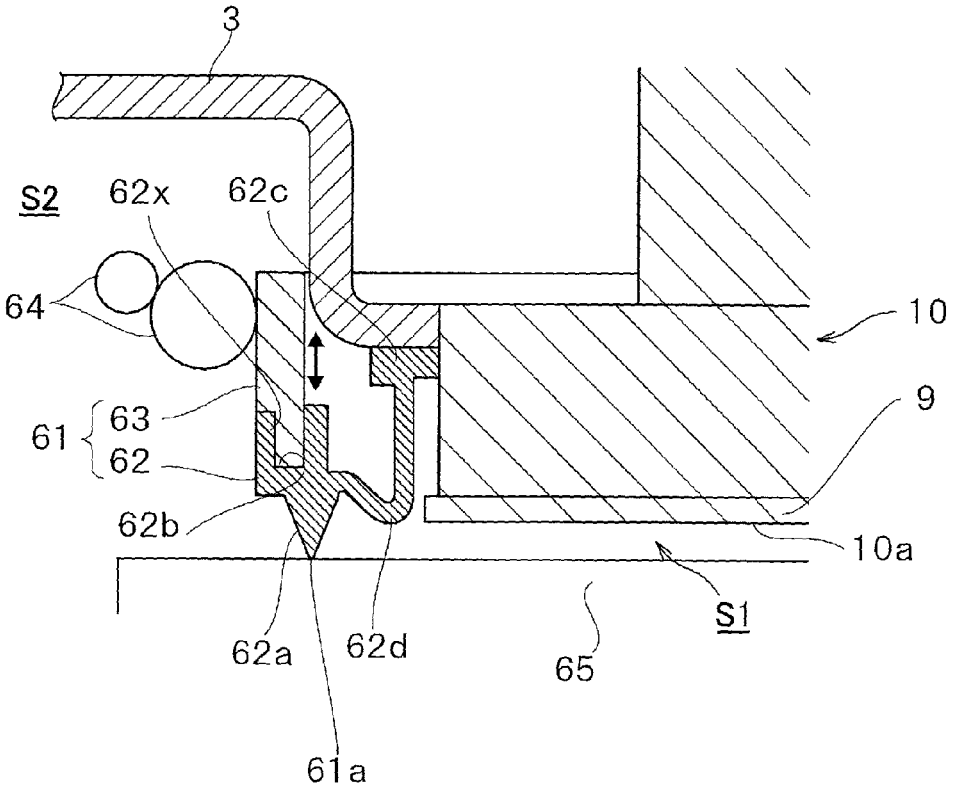
FIG. 8 is a fragmentary cross-sectional view showing a region VI enclosed by long dashed short dashed line in FIG. 2C.

A sleeve member 61, as a second member, is provided around a periphery of the head 10. The sleeve member 61 is attached to the head holder 3 and surrounds an outer periphery of the head 10 in plan view. As shown in FIG. 8, the sleeve member 61 includes an elastic member 62 supported by the head holder 3 and a movable member 63 that is movable upward and downward. The structure of the sleeve member 61 will be later explained.

The conveyance unit 30 includes two conveyance nip roller pairs disposed on one and the other of opposite sides of the platen 40 in a conveyance direction in which the sheet P is conveyed. One of the two conveyance nip roller pairs disposed on an upstream side in the conveyance direction has two rollers 31, 31 disposed so as to be opposed to each other in a vertical direction for nipping the sheet P therebetween while the other of the two conveyance nip roller pairs disposed on a downstream side in the conveyance direction has two rollers 32, 32 disposed so as to be opposed to each other in the vertical direction for nipping the sheet P therebetween. The rollers 31, 31; 32 32 of each conveyance nip roller pair are configured to give a conveyance force to the sheet P such that the sheet P nipped therebetween is conveyed in the conveyance direction. The sheet P to which the conveyance force is given by the rollers 31, 31 of the upstream conveyance nip roller pair is conveyed in the conveyance direction while being supported on the upper surface of the platen 40. The sheet P which has passed on the upper surface of the platen 40 receives a conveyance force given from the rollers 32, 32 of the downstream conveyance nip roller pair and is conveyed downstream in the conveyance direction from the platen 40.

The platen 40 is constituted by a pair of platen plates 41, 42 and is supported by rotation shafts 40*a* extending in the main scanning direction so as to be parallel to the ejection surface 10*a*, such that the platen 40 is openable and closable. The platen 40 is moved by the movement mechanism 90 between the facing position (FIG. 2A) at which the platen 40 faces the ejection surface 10*a* and a non-facing position (FIGS. 2B, 2C) at which the platen 40 does not face the ejection surface 10*a*. When the platen 40 is located at the facing position, the upper surface of the platen 40 facing the ejection surface 10*a* is a support surface by which the sheet P is supported. The upper surface of the platen 40 is formed of a suitable material or suitably processed, for enabling the sheet P to be supported thereon. For instance, a low-tack silicone layer may be formed on the support surface, or a multiplicity of ribs may be formed on the support surface along a sub scanning direction, whereby the sheet P placed on the support surface is prevented from floating. The platen 40 is formed of a resin.

The guide unit 25 includes an upstream guide portion and a downstream guide portion disposed on one and the other of opposite sides of the conveyance unit 30 in the conveyance direction. The upstream guide portion includes three guides 26*a*, 26*b*, 26*c* and two feed roller pairs. Each feed roller pair is constituted by a pair of rollers 27, 27. The upstream guide portion connects the sheet supply unit 1*c* and the conveyance unit 30. The downstream guide portion includes three guides 28*a*, 28*b*, 28*c* and three feed roller pairs. Each feed roller pair is constituted by a pair of rollers 29, 29. The downstream guide portion connects the conveyance unit 30 and the discharged-sheet receiving portion 35.

The sheet supply unit 1*c* includes a sheet tray 23 (accommodating portion) and a sheet supply roller 24. The sheet tray 23 is attachable and detachable to and from the casing 1*a* in the sub canning direction. The sheet tray 23 is a box opening upward and accommodates the sheets P. The sheet supply roller 24 is configured to rotate under a control of the controller 100 and to supply an uppermost one of the sheets P in the sheet tray 23. Here, the sub scanning direction is a direction which is parallel to the conveyance direction in which the sheet P is conveyed by the conveyance unit 30, namely, a horizontal direction in FIG. 1 while the main scanning direction is a direction which is parallel to the horizontal plate in FIG. 1 and orthogonal to the sub scanning direction.

The controller 100 controls operations of various portions of the printer 1 so as to control the printer 1 as a whole. The controller 100 performs image recording on the basis of a print command sent from an external device such as a personal computer (PC) connected to the printer 1. More specifically, the controller 100 controls a conveyance operation of the sheet P, an ink ejection operation which synchronizes the conveyance of the sheet P, etc. The sheet P supplied from the sheet tray 23 by the conveyance operation of the controller 100 is conveyed to the conveyance unit 30 while being guided by the guides 26*a*, 26*b*, 26*c* and nipped by the rollers 27 of the feed roller pairs. The conveyance unit 30 conveys the sheet P between the head 10 and the platen 40. When the sheet P conveyed by the conveyance unit 30 between the head 10 and the platen 40 passes right below the head 10 in the sub scanning direction, the ink is ejected from the ejection openings 108, so that a monochrome image is formed on the sheet P by the ejected ink. The ink ejecting operation from the ejection openings 108 is carried out under a control of the controller 100 on the basis of a detection signal from a sheet sensor 37. Thereafter, the sheet P is conveyed upward while being guided by the guides 28*a*, 28*b*, 28*c* and nipped by the rollers 29 of the feed roller pairs and is finally discharged to the discharged-sheet receiving portion 35 through an opening 38 formed at an upper portion of the casing 1*a*.

The controller 100 carries out maintenance for keeping and recovering an ink ejection property of the head 10. The maintenance includes a discharging operation in which the ink is discharged from the ejection openings 108 (FIG. 5), a wiping operation, and a capping operation in which the ejection space S1 is hermetically closed or sealed with respect to an external space S2. The discharging operation includes flushing and purging. In the flushing, the ink is forcibly ejected from a part of or all of the ejection openings 108 by driving actuators of the head 10 on the basis of flushing data different from image data, whereby the ink is discharged. In the purging, the ink is forcibly discharged from all of the ejection openings 108 by applying a pressure to the ink in the head 10 from the pump 54 (FIG. 9). In this respect, a speed of the ink discharged in the purging is lower than that in the flushing, and a discharge amount of the ink in the purging is larger than that in the flushing. In the present embodiment, the actuators of the head 10 and the pump 54 constitute a liquid discharging mechanism.

The wiping operation includes head wiping and facing-surface wiping (as first-member wiping). In the head wiping, the ink adhering to the ejection surface 10*a* is wiped off. In the facing-surface wiping, an ink adhering to an upper surface of the liquid receiving member 65 (as a facing surface) is wiped off. The capping operation will be later explained.

The liquid receiving member 65 is a flat plate member fixed to an upper surface of an elevating and lowering body 66 and is formed of a material, such as glass or metal (e.g., SUS), which does not absorb or which is hard to absorb an aqueous component. That is, the liquid receiving member 65 is formed to have a configuration that ensures a sufficiently high degree of hermeticity of the ejection space S1 when the ejection space S1 is sealed by the liquid receiving member 65 and the sleeve member 61. The liquid receiving member 65 is disposed so as to be opposed to the ejection surface 10*a* with the platen 40 interposed therebetween when the image recording is performed.

Figure 3A:
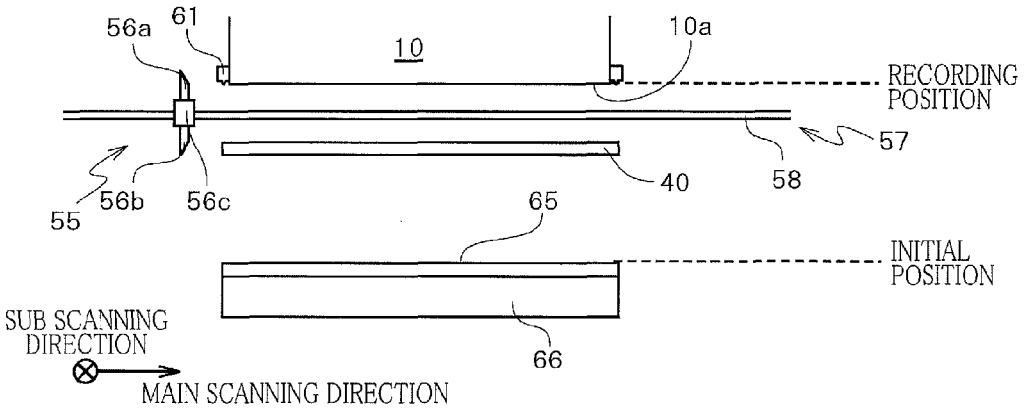
FIGS. 3A-3C are explanatory views each showing a status of a wiping operation.

As shown in FIG. 3, the wiper unit 55 includes a first wiper 56*a*, a second wiper 56*b*, a base body 56*c* supporting the first and the second wipers 56*a*, 56*b*, and a wiper moving mechanism 57. The first wiper 56*a* is a plate-like elastic member such as rubber and has a dimension in the sub scanning direction that is slightly larger than the width of the ejection surface 10*a* in the sub scanning direction. Similarly, the second wiper 56*b* is a plate-like elastic member and has a dimension in the sub scanning direction that is slightly larger than the width of the liquid receiving member 56 in the sub scanning direction. The base body 56*c* is a rectangular parallelepiped whose longitudinal direction coincides with the sub scanning direction. At longitudinally opposite ends of the base body 56*c*, cylindrical holes are formed through the thickness of the base body 56*c* in the main scanning direction. An internal thread is formed on an inner surface of one of the two holes. The wiper moving mechanism 57 is constituted by two guides 58 arranged in the sub scanning direction and a wiper drive motor 59 (FIG. 9) configured to apply a rotational force to one of the two guides 58. The one of the two guides 58 is a round bar disposed on the upstream side of the head 10 in the conveyance direction so as to extend along the main scanning direction. An external thread is formed on an outer circumferential surface of the one of the two guides 58 to which the rotational force is applied from the wiper drive motor 59. The one of the guides 58 is inserted into the one of the holes of the base body 56*c* whose inner surface is internally threaded, such that the external thread of the one of the two guides 58 is held in engagement with the internal thread of the one of the holes of the base body 56*c*. The other of the two guides 58 is a round bar whose outer circumferential surface is not externally threaded and is inserted into the other of the holes of the base body 56*c* whose inner surface is not internally threaded. The base body 56*c* is configured to reciprocatingly move along the guide 58 by rotation of the wiper drive motor 59 in forward and reverse directions. The other of the two guides 58 whose outer circumferential surface is not externally threaded prevents rotation of the base body 56*c*. As shown in FIG. 3A, a position in the vicinity of a left-side end of the head 10 in the main scanning direction is a standby position of the base body 56*c*. In the present embodiment, the wiper drive motor 59 constitutes a wiper drive mechanism.

The movement mechanism 90 is configured to carry out an opening and closing motion of the platen 40 under a control of the controller 100. Accordingly, the movement mechanism 90 functions as a mechanism for moving the platen 40. More specifically, when the image recording is carried out, the movement mechanism 90 permits the pair of platen plates 41, 42 to pivot about the respective rotation shafts 40*a* such that free ends of the respective platen plates 41, 42 are adjacent to each other, whereby the platen 40 is located at the facing position. On the other hand, when the maintenance is carried out, the movement mechanism 90 permits the pair of platen plates 41, 42 to pivot about the respective rotation shafts 40*a* such that the free ends of the respective platen plates 41, 42 are located at respective positions at which the free ends are not opposed to the ejection surface 10*a*, namely, at which the free ends are separated away from the ejection surface 10*a*, whereby the platen 40 is located at the non-facing position. Accordingly, the ink discharged from the ejection openings 108 in the discharging operation of the maintenance is discharged to the liquid receiving member 65 which does not contact the sheet P. As a result, it is possible to prevent the sheet P from being stained with the ink discharged from the ejection openings 108. Further, the platen 40 is configured to be moved between the facing position and the non-facing position by pivoting the pair of platen plates 41, 42, so that the mechanism for moving the platen 40 can be downsized.

The movement mechanism 90 enables the liquid receiving member 65 to be elevated and lowered under a control of the controller 100. That is, the movement mechanism 90 functions also as a distance adjusting mechanism configured to move the liquid receiving member 65. More specifically, the movement mechanism 90 permits the liquid receiving member 65 to be selectively moved to one of an initial position, a first position, a second position, and a third position by moving the elevating and lowering body 66 upward and downward in the vertical direction.

Figure 2A:
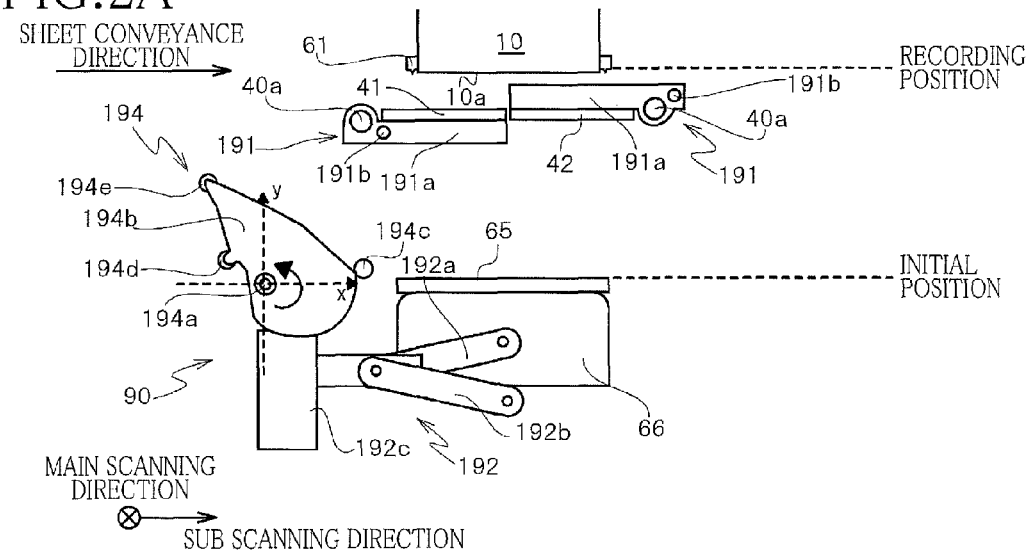
FIGS. 2A-2C are explanatory views each showing a status of a movement mechanism.

As shown in FIG. 2A, the initial position is a position at which the upper surface of the liquid receiving member 65 is located when the image recording is performed. As shown in FIG. 2C, the first position is a position higher than the initial position in the vertical direction. When the liquid receiving member 65 is located at the first position, a distance between the liquid receiving member 65 and the ejection surface 10*a* is equal to a first distance (as a members-abuttable distance) which is smaller than the distance therebetween when the liquid receiving member 65 is located at the initial position. When the movable member 63 of the sleeve member 61 is lowered in a state in which the distance between the liquid receiving member 65 and the ejection surface 10*a* is equal to the first distance, a distal end 61*a* of the sleeve member 61 comes into contact with the liquid receiving member 65, whereby the ejection space S1 can be hermetically or airtightly closed or sealed with respect to the external space S2, namely, the ejection space S1 can be hermetically or airtightly isolated from the external space S2, as shown in FIG. 8. The flushing is carried out when the distance between the liquid receiving member 65 and the ejection surface 10*a* is equal to the first distance. This first distance is a distance that prevents the ink from scattering outside of the liquid receiving member 65 in plan view when the ink is discharged from the head 10 in the flushing.

Figure 2B:
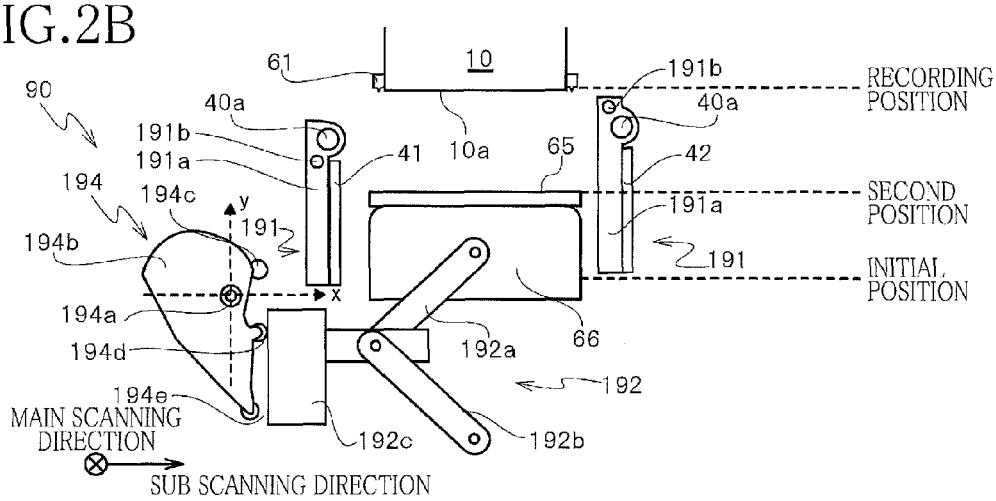
Figure 2C:
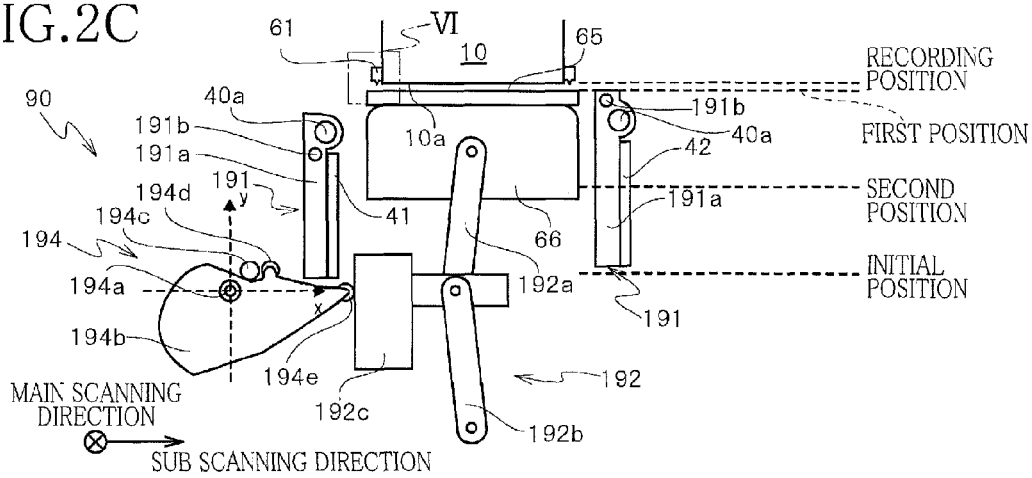

As shown in FIG. 2B, the second position is a position higher than the initial position and lower than the first position, in the vertical direction. When the liquid receiving member 65 is located at the second position, the upper surface of the liquid receiving member 65 is located at a height level slightly lower than a position of a lower end of the second wiper 56*b*. Further, when the liquid receiving member 65 is located at the second position, the distance between the liquid receiving member 65 and the ejection surface 10*a* is equal to a second distance which is smaller than the distance therebetween when the liquid receiving member 65 is located at the initial position and which is larger than the first distance described above when the liquid receiving member 65 is located at the first position. The purging is carried out when the distance between the liquid receiving member 65 and the ejection surface 10*a* is equal to the second distance. This second distance is a distance that prevents the ink from scattering outside of the liquid receiving member 65 in plan view when the ink is discharged from the head 10 in the purging. Further, the second distance is a distance which inhibits the first wiper 56*a* from contacting the liquid receiving member 65 when the first wiper 56*a* is moved along the ejection surface 10*a* and which inhibits the second wiper 56*b* from contacting the ejection surface 10*a* when the second wiper 56*b* is moved along the upper surface of the liquid receiving member 65. In the arrangement, it is possible to reduce a load or burden of adjusting the distance between the ejection surface 10*a* and the liquid receiving member 65 when the head wiping and the facing-surface wiping are carried out after execution of the purging, in an instance where the first wiper 56*a* and the second wiper 56*b* are formed as respective separate members and in an instance where the first wiper 56*a* and the second wiper 56*b* are formed integrally with each other as in the present embodiment and the integrally formed wipers are configured to be movable in the vertical direction.

Figure 3B:
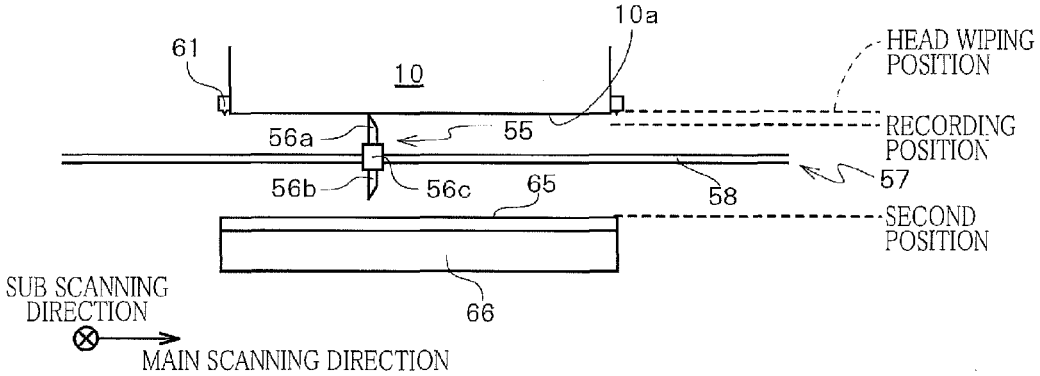
Figure 3C:
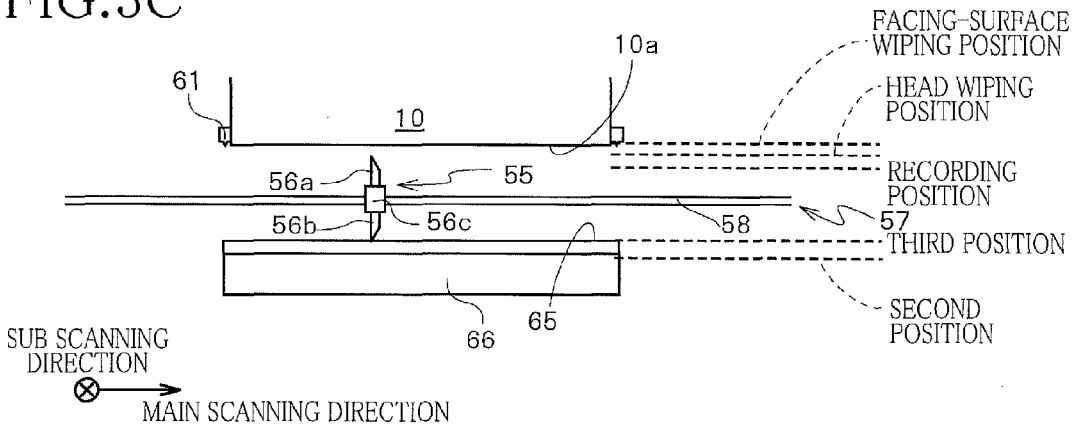

The third position is a position slightly higher than the second position and lower than the first position, as shown in FIG. 3C. When the liquid receiving member 65 is located at the third position, the upper surface of the liquid receiving member 65 is located at a height level slightly higher than the position of the lower end of the second wiper 56*b*, as shown in FIG. 3C. When the base body 56*c* of the wiper unit 55 is moved rightward in FIG. 3 in the facing-surface wiping, the second wiper 56*b* is moved along the upper surface of the liquid receiving member 65 with its lower end kept in contact with the upper surface of the liquid receiving member 65. As a result, the ink adhering to the upper surface of the liquid receiving member 65 can be removed by the second wiper 56*b*. The structure of the movement mechanism 90 will be later explained.

The head elevating and lowering mechanism 50 is configured to move the head holder 3 upward and downward, such that the head 10 is selectively moved to one of a recording position, a head wiping position, and a facing-surface wiping position. As shown in FIG. 3A, the recording position is a position at which the head 10 is opposed to the platen 40 with a distance therebetween suitable for image recording. As shown in FIG. 3B, the head wiping position is a position which is higher than the recording position and at which the head 10 is located in the head wiping. As shown in FIG. 3C, the facing-surface wiping position is a position which is higher than the head wiping position and at which the head 10 is located in the facing-surface wiping.

When the head 10 is located at the head wiping position, the ejection surface 10*a* is located at a height level slightly lower than a position of an upper end of the first wiper 56*a*, as shown in FIG. 3B. When the base body 56*c* of the wiper unit 55 is moved rightward in FIG. 3 in the head wiping, the first wiper 56*a* is moved along the ejection surface 10*a* with its upper end kept in contact with the ejection surface 10*a*. As a result, the ink adhering to the ejection surface 10*a* can be removed by the first wiper 56*a*. On the other hand, when the head 10 is located at the facing-surface wiping position, the ejection surface 10*a* is located at a height level higher than the position of the upper end of the first wiper 56*a*, as shown in FIG. 3C. According to the arrangement, when the base body 56*c* of the wiper unit 55 is moved rightward in FIG. 3 in the facing-surface wiping, the upper end of the first wiper 56*a* does not come into contact with the ejection surface 10*a*.

Figure 4:
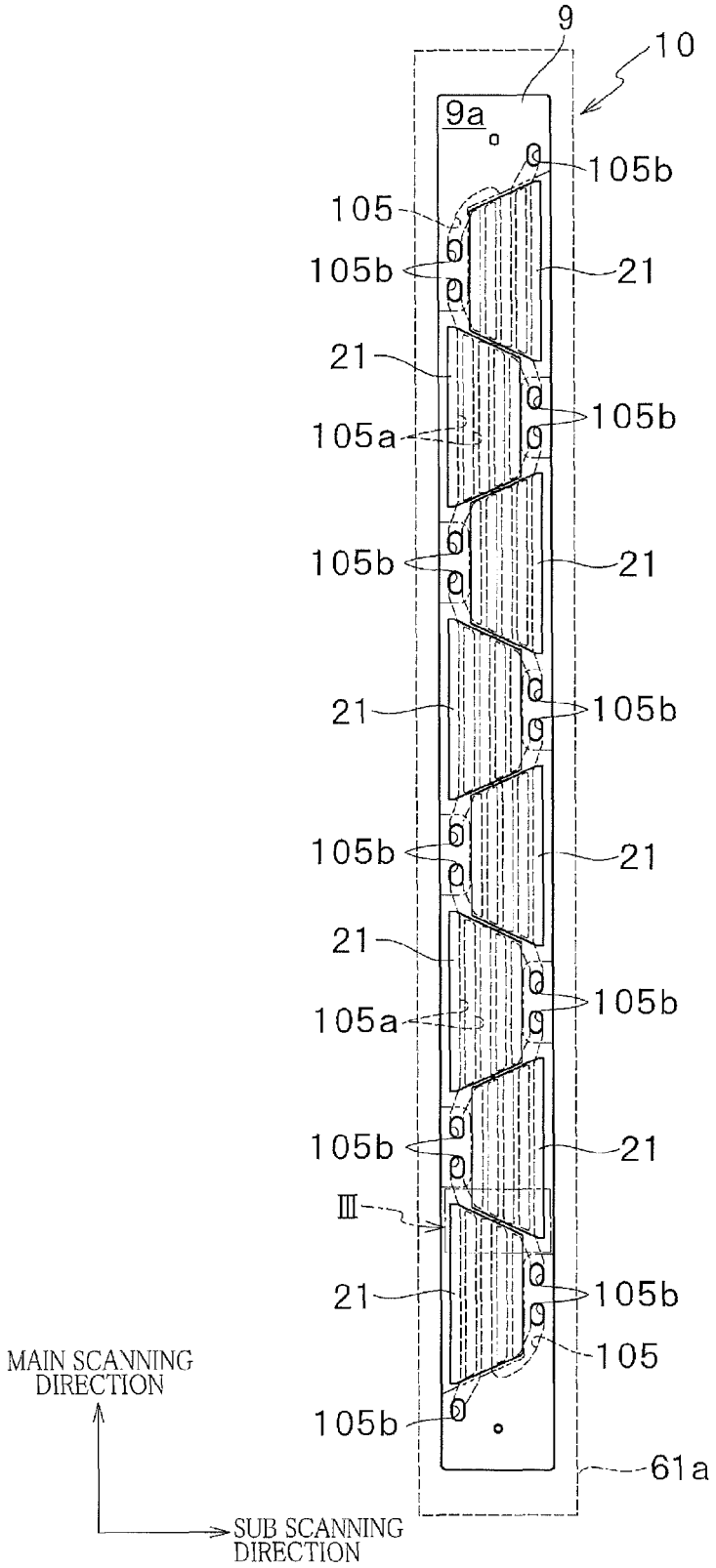
FIG. 4 is a plan view showing a flow-passage unit and actuator units of a liquid ejecting head of the printer of FIG. 1.
Figure 5A:
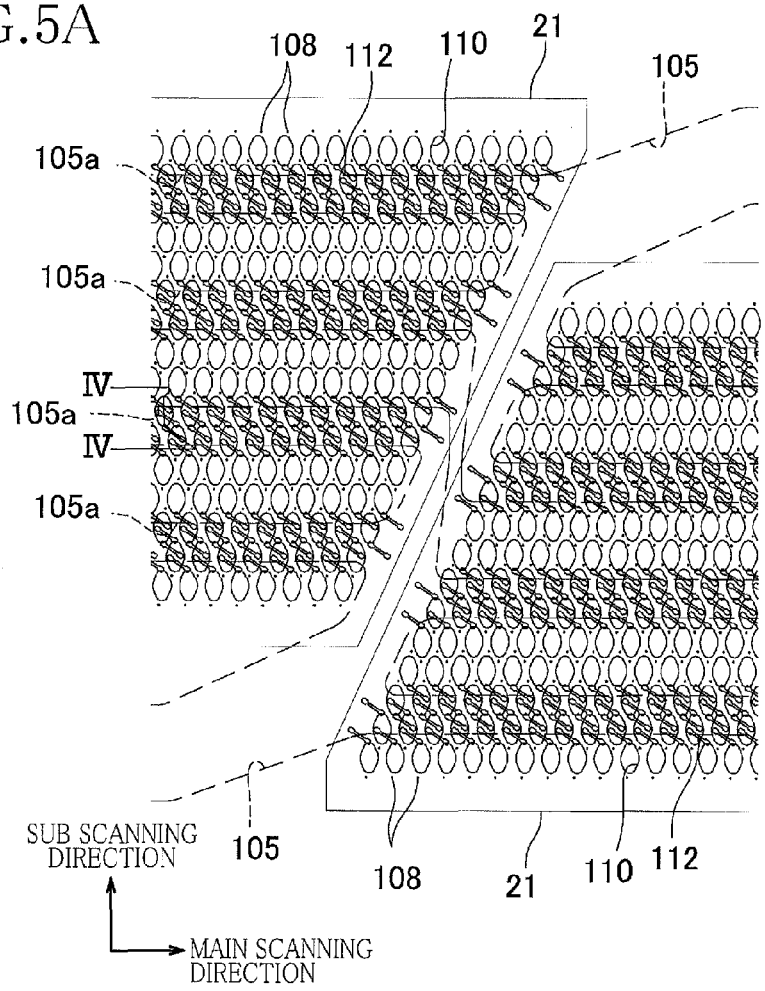
FIG. 5A is an enlarged view showing a region III enclosed by long dashed short dashed line in FIG. 4

Referring next to FIGS. 4 and 5, the head 10 will be explained in detail. In FIG. 5A, pressure chambers 110, apertures 112, and the ejection openings 108 which are provided under the actuator units 21 and therefore should be illustrated in dashed line are illustrated in solid line for the sake of convenience of explanation. As shown in FIG. 4, the head 10 is a stacked body in which eight actuator units 21 are fixed to an upper surface of a flow-passage unit 9. A lower surface of the flow-passage unit 9 is the ejection surface 10*a*. In the flow-passage unit 9, ink flow passages are formed, and the actuator units 21 apply an ejection energy to the ink in the ink flow passages.

Figure 5B:
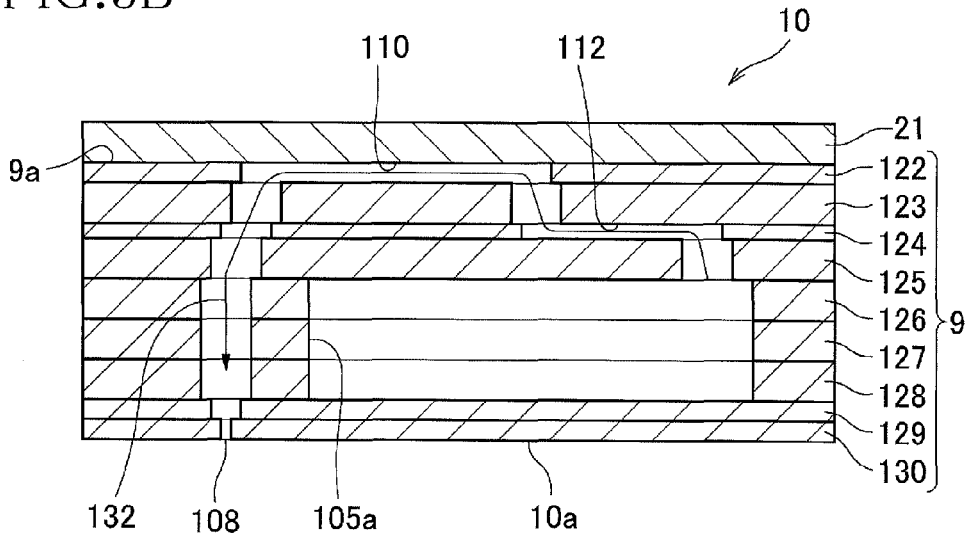
FIG. 5B is a fragmentary cross-sectional view taken along line IV-IV in FIG. 5A.

As shown in FIG. 5B, the flow-passage unit 9 is a stacked member in which nine metal plates 122-130 formed of stainless steel are stacked on each other. On the upper surface of the flow-passage unit 9, eighteen ink supply openings 105*b* communicating with a reservoir unit are open, as shown in FIG. 4. In the flow-passage unit 9, there are formed manifolds 105 each having the ink supply opening 105*b* at one end thereof and sub manifolds 105*a* branched from the manifolds 105, as shown in FIGS. 4 and 5. Further, there are formed individual ink flow channels 132 each extending from an outlet of a corresponding sub manifold 105*a* to a corresponding ejection opening 108 via a corresponding pressure chamber 110. The multiplicity of ejection openings 108 formed in the ejection surface 10*a* are disposed in matrix and arranged in the main scanning direction (one direction) at intervals of 600 dpi corresponding to resolution in the direction.

As shown in FIGS. 4 and 5, the ink supplied from the reservoir unit to the ink supply openings 105*b* flows into the manifolds 105 (the sub manifolds 105*a*). The ink in the sub manifolds 105*a* is distributed into the individual ink flow channels 132 and reaches the ejection openings 108 via the apertures 112 and the pressure chambers 110.

Next, the actuator units 21 are explained. As shown in FIG. 4, each of the eight actuator units 21 has a trapezoidal shape in plan view and are disposed in a zigzag fashion in the main scanning direction so as not to be located on the ink supply openings 105*b*. Parallel opposed sides (short and long sides of the trapezoid) of each actuator unit 21 extend along the main scanning direction while oblique sides of adjacent actuator units 21 partially overlap when viewed from an upstream side or a downstream side in the main scanning direction.

Figure 6:
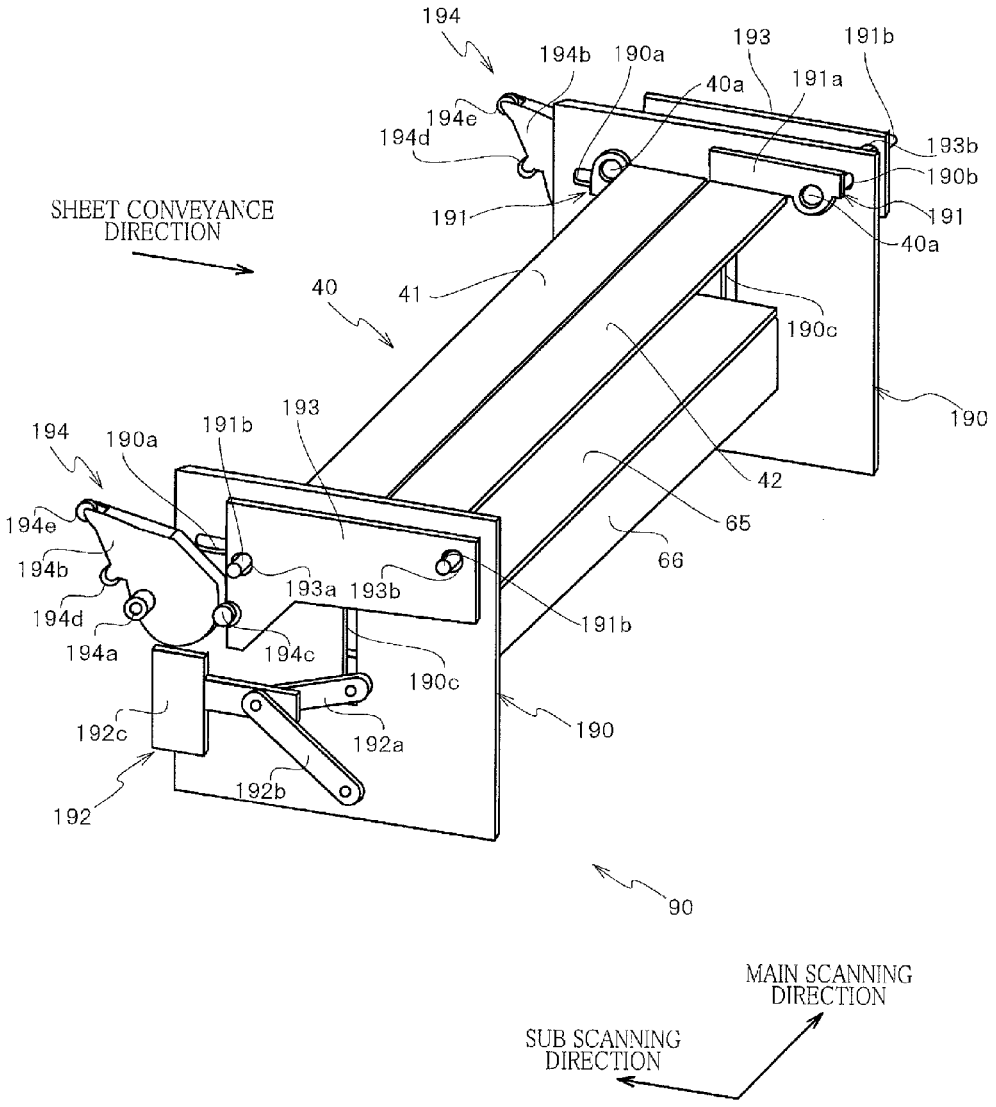
FIG. 6 is a view for explaining a motion of the platen moving mechanism.
Figure 7A:
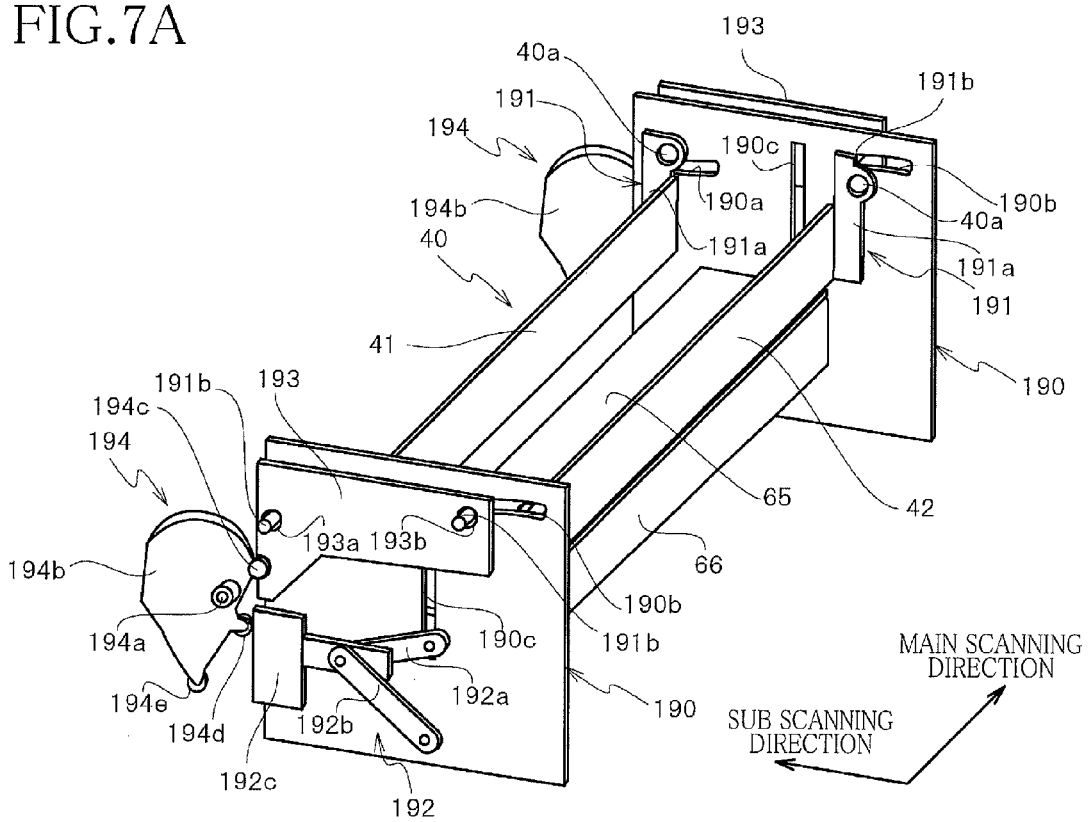
FIGS. 7A and 7B are views each for explaining a motion of the platen moving mechanism.
Figure 7B:
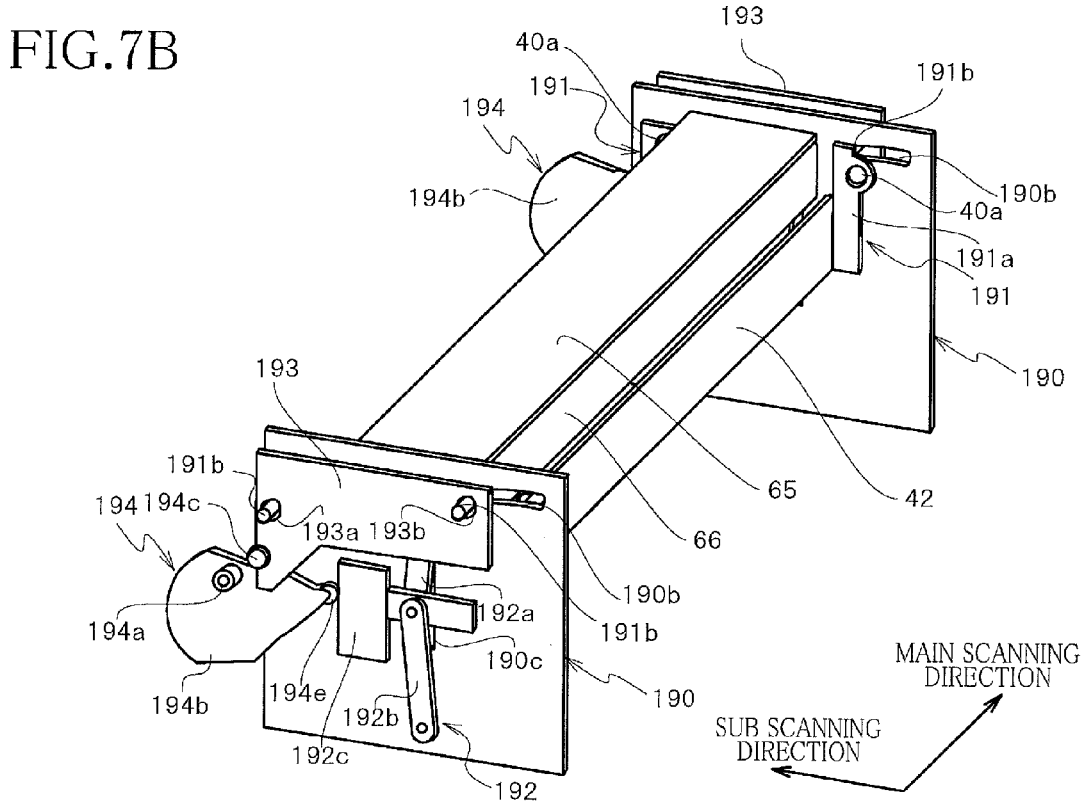

Referring next to FIGS. 2, 6, and 7, the structure of the movement mechanism 90 will be explained. For the sake of convenience, the explanation will be made using an orthogonal coordinate system in which a cam shaft 194*a* corresponds to an origin, the sub scanning direction corresponds to an x-axis (in which the downstream side of the cam shaft 194*a* in the conveyance direction is positive), and the vertical direction corresponds to a y-axis, as shown in FIG. 2. Further, a positive portion of the x-axis is set as a reference (0°) of an angular position, and a counterclockwise direction about an axis extending in the main scanning direction is defined as a positive direction in an angle. As shown in FIGS. 6 and 7, the movement mechanism 90 includes a pair of support members 190, two pairs of platen holding members 191 that hold the platen 40, a pair of link mechanisms 192, a pair of transmission members 193, and a pair of cam mechanisms 194 (each as a drive mechanism).

The support members 190 are fixed to the casing 1*a* so as to interpose the platen 40 therebetween in the main scanning direction. In each of the support member 190, there are formed an arcuate hole 190*a* which is curved downwardly with respect to the positive direction of the x-axis (i.e., with respect to a line parallel to the x-axis) and an arcuate hole 190*b* which is disposed more downstream than the arcuate hole 190*a* in the conveyance direction and which is curved upwardly with respect to the positive direction of the x-axis (i.e., with respect to the line parallel to the x-axis), and a vertical hole 190*c* which is disposed so as to be interposed between the arcuate holes 190*a*, 190*b* and which extend in the vertical direction. The support members 190 rotatably support the rotation shafts 40*a* of the platen 40.

The two pairs of platen holding members 191 hold opposite ends of the platen plate 41 and opposite ends of the platen 42, in the main scanning direction. Each platen holding member 191 includes a base body 191*a* fixed to the rotation shaft 40*a* and a cylindrical protrusion 191*b* extending from the base body 191*a* outwardly in the main scanning direction. The cylindrical protrusion 191*b* of each of the pair of platen holding members 191 which hold the platen plate 41 disposed on the upstream side in the conveyance direction extends from a position lower than the rotation shaft 40*a* and is fitted into the arcuate hole 190*a* of the support member 190. On the other hand, the cylindrical protrusion 191*b* of each of the pair of platen holding members 191 which hold the platen plate 42 disposed on the downstream side in the conveyance direction extends from a position higher than the rotation shaft 40*a* and is fitted into the arcuate hole 190*b* of the support member 190.

Each link mechanism 192 is a toggle mechanism and includes a first link 192*a* having one end connected to the elevating and lowering body 66, a second link 192*b* having one end connected to the other end of the first link 192*a*, and a cam follower 192*c* slidably connected to a_connection position of the first link 192*a* and the second link 192*b*. The first link 192*a* and the second link 192*b* are configured such that respective angles with respect to the cam follower 192*c* are changeable. At the one end of the first link 192*a*, there is provided a fitting protrusion (not shown) which is fitted in the vertical hole 190*c* of the support member 190. In this arrangement, the elevating and lowering body 66 connected to the one end of the first link 192*a* is guided in the vertical direction by the fitting protrusion and the vertical hole 190*c*. The other end of the second link 192*b* is swingably fixed to the support member 190. In the structure, when the cam follower 192*c* moves in the positive direction of the x-axis, the elevating and lowering body 66 (the liquid receiving member 65) is elevated. On the other hand, when the cam follower 192*c* moves in the negative direction of the x-axis, the elevating and lowering body 66 (the liquid receiving member 65) is lowered.

The pair of transmission members 193 are disposed so as to interpose the pair of support members 190 therebetween and are configured so as to be slidable along the support members 190. In each transmission member 193, through-holes 193*a*, 193*b* are formed into which the respective cylindrical protrusions 191*b* of the platen holding member 191 are rotatably fitted.

Each cam mechanism 194 is configured to operate the corresponding link mechanism 192. The cam mechanism 194 includes the cam shaft 194*a* rotatably supported by the corresponding support member 190, a cam 194*b* attached to the cam shaft 194*a*, a roller member 194*c* interposed between the transmission member 193 and the cam 194*b*, two rollers 194*d*, 194*e* which are rotatably supported by the cam 194*b* and which are distant from the axis center of the cam shaft 194*a* by mutually different distances, and a cam drive motor 194*f* (FIG. 9) connected to the cam shaft 194*a*.

The roller member 194*c* is rotatably supported by the transmission member 193 and is configured to roll along a rim of the cam 194*b*. The rim on which the roller member 194*c* of the cam 194*b* rolls is formed such that, when the cam 194*b* rotates counterclockwise in FIG. 2, a distance between the roller member 194*c* and the cam shaft 194*a* continuously decreases in accordance with rotation of the cam 194*b* until the roller 194*d* comes into contact with the cam follower 192*c*. The roller 194*e* is more distant from the axis of the cam shaft 194*a* than the roller 194*d* and is disposed at a smaller angular position with respect to the x-axis as compared with the roller 194*d*. The cam drive motor 194*f* is rotatably driven in forward and reverse directions under a control of the controller 100. The controller 100 detects a rotation angle of the cam 194*b* (the cam drive motor 194*f*) by an encoder attached to the cam drive motor 194*f* and controls the cam drive motor 194*f* on the basis of the detected rotation angle. In the present embodiment, the movement mechanism 90 functions as the distance adjusting mechanism and the mechanism for moving the platen 40.

There will be next explained an opening motion of the platen 40 and an elevating movement of the liquid receiving member 65 executed by the movement mechanism 90 in the maintenance. For the sake of convenience of explanation, the following explanation will be made focusing on one of the two cam mechanisms 194, one of the two transmission members 193, and one of the two link mechanisms 192 because the two cam mechanisms 194 operate in the same manner, the two transmission members 193 operate in the same manner, and the two link mechanisms 192 operate in the same manner. As shown in FIGS. 2A and 6, when the image recording is performed, the liquid receiving member 65 is located at the initial position and the platen 40 is located at the facing position. The rollers 194*d*, 194*e* of the cam mechanism 194 are located in a region in which an x coordinate is negative and a y coordinate is positive while an upstream end in the conveyance direction of the cam follower 192*c* of the link mechanism 192 is located in a region in which both of an x coordinate and a y coordinate are negative.

When the opening motion of the platen 40 and the elevating movement of the liquid receiving member 65 start, the cam 194*b* is rotated counterclockwise in FIG. 2A by the cam drive motor 194*f*, whereby the roller member 194*c* moves in the negative direction of the x-axis (i.e., in a direction toward the cam shaft 194*a*) while rolling on the rim of the cam 194*b*. In association with the movement of the roller member 194*c*, the transmission member 193 which rotatably supports the roller member 194*c* moves in the negative direction of the x-axis. The movement of the transmission members 193 in the negative direction of the x-axis causes the cylindrical protrusions 191*b* respectively fitted in the through-holes 193*a*, 193*b* of the transmission member 193 to be moved in the negative direction of the x-axis while being respectively guided by the arcuate holes 190*a*, 190*b* of the support member 190. As a result, there is generated clockwise rotational moment in the platen plate 41 while there is generated counterclockwise rotational moment in the platen plate 42, so that the platen 40 is moved from the facing position to the non-facing position, as shown in FIG. 7A.

When the platen 40 is located at the non-facing position, the roller member 194*d* comes into contact with the cam follower 192*c*. Accordingly, even where the cam 194*b* is further rotated counterclockwise in FIG. 7A, the platen plates 41, 42 do not rotate any more. Thereafter, when the cam 194*b* is further rotated counterclockwise in FIG. 7A by the cam drive motor 194*f*, the roller 194*d* comes into contact with the cam follower 192*c* so as to push the cam follower 192*c* in the positive direction of the x-axis. As a result, the cam follower 192*c* moves in the positive direction of the x-axis, and the one end of the first link 192*a* is moved upward while being guided in the vertical hole 190*c*. In association with the upward movement of the one end of the first link 192*a*, the liquid receiving member 65 is elevated in the vertical direction.

Here, a movement amount of the liquid receiving member 65*a* in the vertical direction is proportional to a movement amount of the cam follower 192*c* in the x-axis direction. Further, a movement amount of each roller 194*d*, 194*e* in the x-axis direction with respect to a rotation amount of the cam 194*b* is large when a value of the x coordinate of each of the rollers 194*d*, 194*e* is close to 0 and the movement amount of each roller 194*d*, 194*e* in the x-axis direction becomes smaller as the value of the x coordinate of each of the rollers 194*d*, 194*e* becomes away from 0. More specifically, the movement amount of each roller 194*d*, 194*e* in the x-axis direction with respect to the rotation amount of the cam 194*b* is the largest when the rollers 194*d*, 194*e* are located at an angular position corresponding to 270-degree angle and is the smallest when the rollers 194*d*, 194*e* are located at an angular position corresponding to 360-degree angle.

In the present embodiment, the movement mechanism 90 is configured such that the liquid receiving member 65 is located in a range from the second position to the third position when the roller 194*d* is located in a range of 315-360 degrees. In other words, the movement mechanism 90 is configured such that the liquid receiving member 65 is located at the second position and at the third position when the roller 194*d* is located in a range in which the movement amount the roller 194*d* in the x-axis direction with respect to the rotation amount of the cam 194*b* is smaller than that in other range (e.g., in a range of 270-300 degrees), more specifically, when the roller 194*d* is located in a range in which the movement amount of the liquid receiving member 65 in the vertical direction (i.e., a change amount of the distance between the liquid receiving member 65 and the ejection surface 10*a*) with respect to the rotation amount of the cam 194*b* is smaller than that in other range. As a result, even where an error in the rotation angle of the cam 194*b* is generated when the liquid receiving member 65 is located at the second position or the third position, it is possible to enhance positioning accuracy of the liquid receiving member 65.

When the cam 194*b* is further rotated counterclockwise in FIG. 2B by the cam drive motor 194*f*, both of the roller 194*d* and the roller 194*e* come into contact with the cam follower 192*c*, and thereafter only the roller 194*e* is kept in contact with the cam follower 192*c* so as to push the cam follower 192*c* in the positive direction of the x-axis, whereby the cam follower 192*c* is further moved in the positive direction of the x-axis to cause the one end of the first link 192*a* to be moved upward while being guided by the vertical hole 190*c*. Consequently, the liquid receiving member 65 is further elevated so as to be located at the first position.

In the present embodiment, as shown in FIG. 2C, the liquid receiving member 65 is configured to be located at the first position when the roller 194*e* is located at a position corresponding to 360-degree angle. Accordingly, even where an error in the rotation angle of the cam 194*b* is generated when the liquid receiving member 65 is located at the first position, it is possible to enhance positioning accuracy of the liquid receiving member 65. The closing motion of the platen 40 and the lowering movement of the liquid receiving member 65 are carried out by implementing the above described procedure in a reverse order.

Referring next to FIGS. 4 and 8, the head holder 3 and the sleeve member 61 will be explained. The head holder 3 is a frame-like member made of metal or the like and supports the side surface of the head 10 over its entire periphery. The sleeve member 61 is attached to the head holder 3. The contact portion of the head holder 3 and the head 10 is sealed by a sealing agent over entire peripheries thereof. The head holder 3 and the sleeve member 61 are fixed to each other at a contact portion thereof by an adhesive over entire peripheries thereof.

The elastic member 62 of the sleeve member 61 is formed of a sleeve-like elastic member made of rubber or the like. The elastic member 62 surrounds the head 10 in plan view. As shown in FIG. 8, the elastic member 62 includes a base portion 62*x*, a protruding portion 62*a* which protrudes from a lower surface of the base portion 62*x*, a fixed portion 62*c* fixed to the head holder 3, and a connecting portion 62*d* connecting the base portion 62*x* and the fixed portion 62*c*. The protruding portion 62*a* has a triangular cross-sectional shape. The fixed portion 62*c* has T-like cross sectional shape. The fixed portion 62*c* is fixed to the head holder 3 at an upper end section thereof by an adhesive or the like. The connecting portion 62*d* extends from a lower end of the fixed portion 62*c* outwardly, i.e., in a direction away from the ejection surface 10*a* in plan view, in a curved manner, and is connected to a lower end of the base portion 62*x*. The connecting portion 62*d* deforms in association with an elevating and lowering movement of the movable member 63. In an upper surface of the base portion 62*x*, there is formed a recess 62*b* into which a lower end portion of the movable member 63 is fitted.

The movable member 63 is formed of a sleeve-like member made of a rigid material such as stainless steel, and surrounds the outer periphery of the head 10 in plan view. The movable member 63 is supported by the elastic member 62 and is movable in the vertical direction relative to the head holder 3. The movable member 63 is connected to a plurality of gears 64. When the elevating and lowering motor 60 (FIG. 9) is driven under a control of the controller 100, the gears 64 are rotated so as to move the movable member 63 upward and downward. On this occasion, the base portion 62*x* moves upward and downward together with the movable member 63, whereby a relative position of the distal end 61*a* of the protrusion 62 and the ejection surface 10*a* changes in the vertical direction.

When the liquid receiving member 65 is located at the first position, the protruding portion 62*a* is selectively placed between an abutting position (FIG. 8) at which the distal end 61*a* contacts the upper surface of the liquid receiving member 65 and a separate position (FIG. 2C) at which the distal end 61*a* is separated away from the upper surface of the liquid receiving member 65, in association with the upward and downward movements of the movable member 63. At the abutting position, the ejection space S1 is in a hermetically closed or air-tightly sealed state with respect to the external space S2. At the separate position, the ejection space S1 is open to the external space S2, namely, the ejection space S1 is in a hermetically non-closed or air-tightly non-sealed state with respect to the external space S2. It is noted that a capping mechanism is constituted by the elevating and lowering motor 60, the sleeve member 61, the gears, 64, and the liquid receiving member 65.

Referring next to FIG. 9, the controller 100 will be explained. The controller 100 includes a Central Processing Unit (CPU), a Read Only Memory (ROM) which stores programs to be executed by the CPU and which rewritably stores data to be used in the programs, and a Random Access Memory (RAM) which temporarily stores data when the programs are executed. Various functional sections of the controller 100 are constituted by the hardware and the software in the ROM. As shown in FIG. 9, the controller 100 includes a conveyance control section 141, an image data storage section 142, a head control section 143, a discharge data measuring section 144, a judging section 145, a maintenance judging section 146, a liquid discharge control section 147, a capping control section 148, a liquid-receiving-member elevating and lowering control section 149, a head elevating and lowering control section 150, and a wiping control section 151.

The conveyance control section 141 is configured to control operations of the sheet supply unit 1*c*, the guide unit 25, and the conveyance unit 30 on the basis of a print command received from the external device, such that the sheet P is conveyed at a prescribed speed along the conveyance direction. The image data storage section 142 is configured to store image data contained in the print command received from the external device.

The head control section 143 is configured to control the head 10 on the basis of the image data stored in the image data storage section 142, such that the ink is ejected to the sheet P that is being conveyed, when image recording is performed. The discharge data measuring section 144 is configured to measure an elapsed time from a time point when flushing is initially carried out after the latest wiping operation has been carried out and a discharge amount of the ink discharged in flushing after the latest wiping operation has been carried out. The judging section 145 is configured to judge whether the elapsed time measured by the discharge data measuring section 144 is equal to or longer than a prescribed time and to judge whether the discharge amount of the ink measured by the discharge data measuring section 144 is equal to or larger than a prescribed amount.

The maintenance judging section 146 is configured to judge whether the discharging operation, the wiping operation, the capping operation, or an uncapping operation (for releasing the capping state) is to be carried out. More specifically, the maintenance judging section 146 judges the flushing or the purging is to be carried out as the discharging operation where the ink is not ejected from the ejection openings 108 for a time period which is not shorter than a prescribed time period. (Here, the prescribed time period set for the purging may be longer than that set for the flushing.) The maintenance judging section 146 judges that the wiping operation is to be carried out where the judging section 145 judges that the elapsed time measured by the discharge data measuring section 144 is equal to or longer than the prescribed time or where the judging section 145 judges that the discharge amount of the ink measured by the discharge data measuring section 144 is equal to or larger than the prescribed amount. Further, the maintenance judging section 146 judges that the wiping operation is to be carried out after the purging has been carried out. Moreover, the maintenance judging section 146 judges that the capping operation is to be carried out where no print command is received until a prescribed time elapses after completion of the image recording based on the print command. The maintenance judging section 146 judges that the uncapping operation is to be carried out when a print command is received from the external device when the ejection space S1 is being hermetically closed owing to capping by the sleeve member 61. In instances other than those described above, where an order for carrying out one of the discharging operation, the wiping operation, the capping operation, and the uncapping operation is inputted by a user through a touch panel (not shown), the maintenance judging section 146 judges that the ordered one of the operations is to be carried out.

The liquid discharge control section 147 is configured to control the head 10 such that the flushing is carried out on the basis of the flushing data. Further, the liquid discharge control section 147 is configured to control the pump 54 such that the purging is carried out. The capping control section 148 is configured to control the elevating and lowering motor 60 such that the capping operation and the uncapping operation are carried out. The liquid-receiving-member elevating and lowering control section 149 is configured to control the cam drive motor 194*f* such that the elevating and lowering movement of the liquid receiving member 65 and the opening and closing motion of the platen 40 are carried out. The head elevating and lowering control section 150 is configured to control the head elevating and lowering mechanism 50 such that the elevating and lowering movement of the head 10 is carried out. The wiping control section 151 is configured to control the wiper drive motor 59 such that the head wiping and the facing-surface wiping are carried out.

Figure 10:
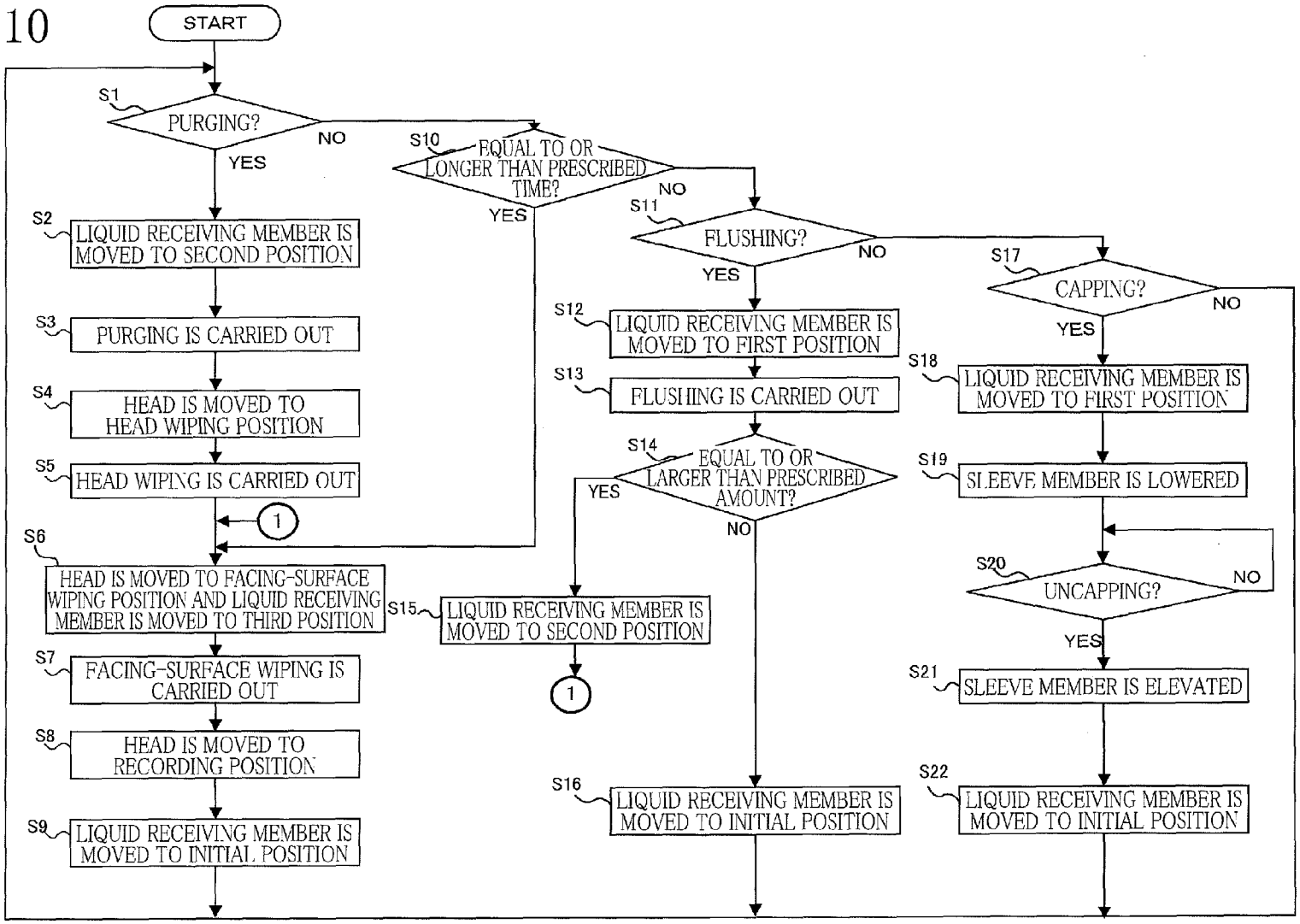
FIG. 10 is a flow chart relating to maintenance executed by the controller shown in FIG. 1.

Referring next to FIG. 10, the maintenance of the printer 1 will be explained. It is noted that an initial state at a time when the flow of FIG. 10 starts corresponds to a state immediately after the image recording has been performed. In other words, as shown in FIG. 2A, the liquid receiving member 65 is located at the initial position and the platen 40 is located at the facing position.

Initially, the maintenance judging section 146 judges whether the purging is to be carried out (S1). Where the maintenance judging section 146 judges that the purging is to be carried out (S1: YES), the liquid-receiving-member elevating and lowering control section 149 controls the cam drive motor 194*f* such that the platen 40 is moved from the facing position to the non-facing position and such that the liquid receiving member 65 is moved from the initial position to the second position (FIG. 2B) (S2). Subsequently, the liquid discharge control section 147 permits the purging to be carried out (S3). That is, the liquid discharge control section 147 controls the pump 54 such that the ink is discharged to the upper surface of the liquid receiving member 65.

After S3, the head elevating and lowering control section 150 controls the head elevating and lowering mechanism 50 to move the head 10 from the recording position to the head wiping position (S4). Subsequently, as shown in FIG. 3B, the wiping control section 151 controls the wiper drive motor 59 such that the head wiping for wiping off the ink adhering to the ejection surface 10*a* is carried out (S5). When the head wiping is completed, the head elevating and lowering control section 150 controls the head elevating and lowering mechanism 50 to move the head 10 to the facing-surface wiping position and the liquid-receiving-member elevating and lowering control section 149 controls the cam drive motor 194*f* such that the liquid receiving member 65 is moved to the third position (FIG. 3C) (S6). Thereafter, the wiping control section 151 controls the wiper drive motor 59 such that the facing-surface wiping for wiping off the ink adhering to the upper surface of the liquid receiving member 65 is carried out (S7). Thus, the ink adhered to the ejection surface 10*a* and the liquid receiving member 65 in the discharging operation is removed by the wiping operation, so as to prevent the ink from remaining and solidifying on the ejection surface 10*a* and the liquid receiving member 65. Further, the facing-surface wiping is arranged to be carried out after the head wiping has been carried out as described above. Accordingly, even where the ink moves from the ejection surface 10*a* onto the liquid receiving member 65 in the head wiping, the ink can be reliably wiped off by the facing-surface wiping. Therefore, the ink can be wiped off with high reliability without remaining on the ejection surface 10*a* and the liquid receiving member 65.

After S7, the head elevating and lowering control section 150 controls the head elevating and lowering mechanism 50 to move the head 10 back to the recording position (S8). Subsequently, the liquid-receiving-member elevating and lowering control section 149 controls the cam drive motor 194*f* such that the liquid receiving member 65 is moved back to the initial position and such that the platen 40 is moved back to the facing position (S9), and the control goes back to the processing in S1. In view of the movement of the head 10 by the head elevating and lowering mechanism 50 carried out in S4, S6, S8 in association with the wiping operation, it may be considered that the head elevating and lowering mechanism 50 functions as the distance adjusting mechanism.

On the other hand, where the maintenance judging section 146 judges in S1 that the purging is not to be carried out (S1: NO), the maintenance judging section 146 judges whether the judging section 145 is judging that the elapsed time measured by the discharge data measuring section 144 is equal to or longer than the prescribed time (S10). Where the maintenance judging section 146 judges that the judging section 145 is judging that the elapsed time is equal to or longer than the prescribed time (S10: YES), the control goes to the processing in S6 for execution of the facing-surface wiping. Accordingly, it is possible to prevent the ink adhering to the liquid receiving member 65 from remaining on the liquid receiving member 65 and solidifying thereon with a lapse of time.

On the other hand, where the maintenance judging section 146 judges in S10 that the judging section 145 is not judging that the elapsed time is equal to or longer than the prescribed time (S10: NO), the maintenance judging section 146 judges whether the flushing is to be carried out (S11). Where it is judged that the flushing is to be carried out (S11: YES), the liquid-receiving-member elevating and lowering control section 149 controls the cam drive motor 194*f* such that the platen 40 is moved from the facing position to the non-facing position and such that the liquid receiving member 65 is moved from the initial position to the first position (FIG. 2A) (S12). Thereafter, the liquid discharge control section 147 permits the flushing to be carried out (S13). That is, the liquid discharge control section 147 controls the head 10 so as to discharge the ink to the upper surface of the liquid receiving member 65.

After S13, the maintenance judging section 146 judges whether the judging section 145 is judging that the discharge amount of the ink measured by the discharge data measuring section 144 is equal to or larger than the prescribed amount (S14). Where the maintenance judging section 146 judges that the judging section 145 is judging that the discharge amount of the ink is equal to or larger than the prescribed amount (S14: YES), the liquid-receiving-member elevating and lowering control section 149 controls the cam drive motor 194*f* such that the liquid receiving member 65 is moved from the first position to the second position (S15). Thereafter, the control goes back to the processing in S6-S7 for execution of the facing-surface wiping. Accordingly, it is possible to prevent a large amount of the ink from remaining on the liquid receiving member 65.

On the other hand, it is judged in S14 that the judging section 145 is not judging that the discharge amount of the ink is equal to or larger than the prescribed amount (S14: NO), the liquid-receiving-member elevating and lowering control section 149 controls the cam drive motor 194*f* such that the liquid receiving member 65 is moved back to the initial position and such that the platen 40 is moved to the facing position (S16), and the control goes back to the processing in S1.

Where the maintenance judging section 146 judges in S11 that the flushing is not to be carried out (S11: NO), the maintenance judging section 146 judges whether the capping is to be carried out or not (S17). Where the maintenance judging section 146 judges that the capping is not to be carried out (S17: NO), the control goes back to the processing in S1. On the other hand, where the maintenance judging section 146 judges that the capping is to be carried out (S17: YES), the liquid-receiving-member elevating and lowering control section 149 controls the cam drive motor 194*f* such that the platen 40 is moved to the non-facing position and such that the liquid receiving member 65 is moved from the initial position to the first position (S18). Thereafter, the capping control section 148 controls the elevating and lowering motor 60 such that the ejection space S1 is hermetically closed so as to be isolated from the external space S2 (S19). On this occasion, the distal end 61*a* of the sleeve member 61 comes into contact with the upper surface of the liquid receiving member 65.

After S19, the maintenance judging section 146 judges whether the uncapping operation is to be carried out or not (S20). Where the maintenance judging section 146 judges that the uncapping operation is not to be carried out (S20: NO), the processing in S20 is repeated. On the other hand, where it is judged that the uncapping operation is to be carried out (S20: YES), the capping control section 148 controls the elevating and lowering motor 60 such that the capping state is released for permitting the ejection space S1 to be open to the external space S2 (S21). Thereafter, the liquid-receiving-member elevating and lowering control section 149 controls the cam drive motor 194*f* such that the platen 40 is moved to the facing position and such that the liquid receiving member 65 is moved back to the initial position (S22), and the control goes back to the processing in S1.

As a modification, the flushing may be carried out between S21 and S22. In this instance, the flushing can be performed without changing the position of the liquid receiving member 65, whereby a time required for the maintenance can be shortened.

As explained above, in the printer 1 of the present embodiment, the liquid receiving member 65 and the sleeve member 61 used for hermetically closing the ejection space S1 with respect to the external space S2 are not required so as to have configurations suitable for image recording. Accordingly, it is possible to form the liquid receiving member 65 and the sleeve member 61 so as to have respective configurations that ensure a sufficiently high degree of hermeticity of the ejection space S1, thereby enhancing the hermeticity of the ejection space S1 when the ejection space S1 is hermetically closed with respect to the external space S2.

In the printer 1 of the present embodiment, the flushing and the purging are performed when the platen 40 is located at the non-facing position. Therefore, the ink discharged from the ejection openings is attached to the liquid receiving member 65 which does not contact the sheet P, so that it is possible to prevent the ink discharged from the ejection openings from attaching to the platen 40 and accordingly staining the sheet P in image recording.

In the printer 1 of the present embodiment, when the purging, in which the liquid discharged from the ejection openings is unlikely to scatter upon attaching to the liquid receiving member 65 as compared with the flushing, is performed, the distance between the ejection surface 10*a* and the liquid receiving member 65 is set to the second distance larger than the first distance by which the ejection surface 10*a* and the liquid receiving member 65 are distant from each other when the flushing is performed. In other words, the liquid receiving member 65 is moved from the initial position to the second position without moving to the first position, whereby a distance over which the liquid receiving member 65 is moved can be made small. As a result, the time required for the maintenance can be shortened.

While the embodiment of the present invention has been described, it is to be understood that the present invention is not limited to the details of the illustrated embodiment, but may be modified with various changes without departing from the scope of the invention defined in the attached claims. For instance, while, in the illustrated embodiment, the second position of the liquid receiving member 65 is higher than the initial position, the second position may be the initial position. In the illustrated embodiment, while the distal end 61*a* of the sleeve member 61 is configured to be moved upward and downward, the distal end 61*a* may be otherwise modified. For instance, the distal end 61*a* of the sleeve member 61 may be immovably fixed to the head holder, and the relative position of the distal end 61*a* of the sleeve member 61 with respect to the ejection surface may be constant. In this instance, the distal end 61*a* of the sleeve member 61 and the liquid receiving member 65 may come into contact with each other when the liquid receiving member 65 is located at the first position, namely, when the distance between the liquid receiving member 65 and the ejection surface 10*a* is the first distance.

In the illustrated embodiment, the distance between the liquid receiving member 65 and the ejection surface 10*a* is adjusted to the first distance and the second distance by elevating and lowering the liquid receiving member 65 by the movement mechanism 90 functioning as the distance adjusting mechanism. The distance adjusting mechanism may be configured to adjust the distance between the liquid receiving member 65 and the ejection surface 10*a* to the first distance and the second distance by elevating and lowering the head 10 or by elevating and lowering both of the liquid receiving member 65 and the head 10. Further, the mechanism for moving the platen 40 and the mechanism for elevating and lowering the liquid receiving member 65 are formed integrally as the movement mechanism 90 in the illustrated embodiment. However, the mechanism for moving the platen 40 and the mechanism for elevating and lowering the liquid receiving member 65 may be formed as respective independent mechanisms and the mechanisms may be controlled independently of each other, for thereby controlling the movements of the platen 40 and the liquid receiving member 65 independently of each other.

The present invention is applicable to both of a line-type head and a serial-type head. Further, the present invention is applicable to not only the printer, but also a facsimile machine, a copying machine and the like. Moreover, the present invention is applicable to a liquid ejecting apparatus configured to perform recording by ejecting a liquid other than the ink. The recording medium is not limited to the sheet P, but may be various recordable media. In addition, the present invention is applicable irrespective of a manner of ink ejection.

What is claimed is:

1. A liquid ejecting apparatus, comprising:

a liquid ejecting head having an ejection surface in which ejection openings are open for ejecting a liquid, the liquid ejecting head being configured to record an image by ejecting the liquid toward a recording medium;

a platen configured to be located at a facing position at which the platen faces the ejection surface for supporting the recording medium, when image recording is carried out;

a first member configured to be disposed so as to be opposed to the ejection surface with the platen interposed therebetween, when the image recording is carried out;

a distance adjusting mechanism configured to adjust a distance between the ejection surface and the first member by moving at least one of the liquid ejecting head and the first member;

a liquid discharging mechanism configured to carry out a discharging operation in which the liquid in the liquid ejecting head is discharged from the ejection openings, the liquid discharging mechanism being configured to carry out, each as the discharging operation, flushing in which the liquid is discharged by ejection of the liquid in the liquid ejecting head and purging in which the liquid in the liquid ejecting head is ejected at a liquid speed lower than that in the flushing; and a controller configured to control the distance adjusting mechanism and the liquid discharging mechanism such that the distance between the ejection surface and the first member is equal to a first distance when the liquid discharging mechanism carries out the flushing and such that the distance between the ejection surface and the first member is equal to a second distance larger than the first distance when the liquid discharging mechanism carries out the purging.

2. The liquid ejecting apparatus according to claim 1, further comprising a platen moving mechanism configured to move the platen between the facing position and a non-facing position at which the platen does not face the ejection surface, wherein the controller is configured to control the platen moving mechanism and the liquid discharging mechanism such that the discharging operation is carried out when the platen is located at the non-facing position.

3. The liquid ejecting apparatus according to claim 2, further comprising a capping mechanism configured to hermetically close an ejection space that is opposed to the ejection surface, with respect to an external space, the capping mechanism comprising the first member.

4. The liquid ejecting apparatus according to claim 3, wherein the capping mechanism further comprises a sleeve-like second member disposed around the liquid ejecting head so as to surround the liquid ejecting head, the second member being configured to cooperate with the first member to hermetically close the ejection space with respect to the external space, and wherein the controller is configured to control the platen moving mechanism and the distance adjusting mechanism such that the distance between the ejection surface and the first member is equal to a members-abuttable distance that allows the second member and the first member to abut on each other.

5. The liquid ejecting apparatus according to claim 4, wherein the first distance is equal to the members-abuttable distance.

6. The liquid ejecting apparatus according to claim 2, wherein the platen is constituted by a pair of platen plates each configured to pivot about a pivot axis parallel to the ejection surface, and wherein the platen moving mechanism is configured to move the platen between the facing position and the non-facing position by rotating each of the pair of platen plates so as to pivot the pair of platen plates such that free ends of the respective platen plates are adjacent to each other for locating the platen at the facing position and so as to pivot the pair of platen plates such that the free ends of the respective platen plates are disposed at respective positions at which the free ends are separated away from each other.

7. The liquid ejecting apparatus according to claim 1, further comprising: a first wiper configured to move along the ejection surface; and a wiper drive mechanism configured to drive the first wiper such that the first wiper moves along the ejection surface with the first wiper kept in contact with the ejection surface, for permitting head wiping for wiping off the liquid attached to the ejection surface to be carried out as a wiping operation, wherein the second distance is a distance that inhibits the first wiper from contacting the first member when the first wiper moves along the ejection surface.

8. The liquid ejecting apparatus according to claim 7, further comprising a second wiper configured to move along a facing surface of the first member which faces the ejection surface, wherein the wiper driving mechanism is configured to drive the second wiper such that the second wiper moves along the facing surface with the second wiper kept in contact with the facing surface, for permitting first-member wiping for wiping off the liquid attached to the facing surface to be carried out as the wiping operation, and wherein the second distance is a distance that inhibits the second wiper from contacting the ejection surface when the second wiper moves along the facing surface.

9. The liquid ejecting apparatus according to claim 8, wherein the distance adjusting mechanism is configured to adjust the distance between the ejection surface and the first member by moving at least one of the liquid ejecting head and the first member such that the liquid ejecting head and the first member are moved relative to each other, and wherein the controller controls the wiper driving mechanism such that the head wiping is carried out after the purging was carried out by the liquid discharging mechanism and thereafter controls the wiper driving mechanism and the distance adjusting mechanism such that the first-member wiping is carried out, by moving the first member to a position at which the second wiper can contact the facing surface of the first member and by moving the liquid ejecting head to a position at which the first wiper does not contact the ejection surface.

10. The liquid ejecting apparatus according to claim 7, wherein the controller is configured to control the wiper driving mechanism such that the wiping operation is carried out when the liquid discharging mechanism carried out the purging.

11. The liquid ejecting apparatus according to claim 7, wherein the controller is configured to control the wiper driving mechanism such that the wiping operation is carried out where the discharge amount of the liquid discharged in the discharging operation by the liquid discharging mechanism becomes equal to or larger than a prescribed amount or where a prescribed time elapses after the liquid was discharged in the discharging operation.

12. The liquid ejecting apparatus according to claim 1, wherein the distance adjusting mechanism includes: a drive mechanism having a cam configured to rotate in forward and reverse directions; and a link mechanism connected to the first member and configured to be operable by rotation of the cam, and wherein the link mechanism is configured to change the distance between the ejection surface and the first member in accordance with the rotation of the cam, and a change amount of the distance with respect to a rotation amount of the cam is made smaller in a prescribed range of the distance centering around the first distance and in a prescribed range of the distance centering around the second distance, than in other range.

13. The liquid ejecting apparatus according to claim 1, wherein a discharge amount in the purging is larger than that in the flushing.

* * * * *